US007132596B2

(12) United States Patent
Nakabo et al.

(10) Patent No.: US 7,132,596 B2
(45) Date of Patent: Nov. 7, 2006

(54) AUTOMATIC MUSIC SELECTING SYSTEM IN MOBILE UNIT

(75) Inventors: Masatoshi Nakabo, Hyogo (JP); Norio Yamashita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 191 days.

(21) Appl. No.: 10/847,388

(22) Filed: May 18, 2004

(65) Prior Publication Data

US 2004/0244568 A1 Dec. 9, 2004

(30) Foreign Application Priority Data

Jun. 6, 2003 (JP) ..... 2003-162667

(51) Int. Cl.
*G10H 7/00* (2006.01)

(52) U.S. Cl. ..... 84/615; 84/609; 701/1; 701/200; 701/208

(58) Field of Classification Search ..... 84/615, 84/609, 611; 705/64; 701/1, 200, 208
See application file for complete search history.

(56) References Cited

U.S. PATENT DOCUMENTS 5,157,614 A * 10/1992 Kashiwazaki et al. ..... 701/200
5,790,975 A * 8/1998 Kashiwazaki et al. ..... 701/208
5,944,768 A * 8/1999 Ito et al. ..... 701/200
6,678,609 B1 * 1/2004 Duckeck et al. ..... 701/200
6,889,136 B1 * 5/2005 Herz et al. ..... 701/207
2001/0007089 A1 * 7/2001 Takeuchi ..... 701/211
2002/0152021 A1 * 10/2002 Ota et al. ..... 701/208
2004/0003706 A1 * 1/2004 Tagawa et al. ..... 84/609
2005/0172788 A1 * 8/2005 Yamamoto ..... 84/611

FOREIGN PATENT DOCUMENTS

CN 2370428 Y 3/2000
JP 08-248953 A 9/1996
JP 08248953 A * 9/1996
JP 09292247 A * 11/1997
JP 2001189969 * 7/2001
WO WO 01/60083 A2 8/2001

* cited by examiner

*Primary Examiner*—Lincoln Donovan
*Assistant Examiner*—Christina Russell
(74) *Attorney, Agent, or Firm*—Sughrue Mion, PLLC

(57) ABSTRACT

An automatic music selecting system is provided which can select a piece of music more suitable for an occupant of a mobile unit. It includes a music data storing section that stores music data corresponding to a plurality of pieces of music; a navigation system for detecting the current position of the mobile unit; a first keyword generating section for generating a first keyword in response to current position information indicating the current position detected by the navigation system; sensors for detecting environment of the mobile unit; a second keyword generating section for generating a second keyword in response to the environment information indicating the environment detected by the sensors, a music selecting section for selecting a piece of music in response to the first keyword and second keyword; and a reproducing section for reading the selected music data from the music data storing section to reproduce.

9 Claims, 8 Drawing Sheets

AUTOMATIC MUSIC SELECTING SYSTEM IN MOBILE UNIT

BACKGROUND OF THE INVENTION

1. Field of the Invention

The present invention relates to an automatic music selecting system used in an audio system installed in a mobile unit, and more particularly to a technique for carrying out music selection appropriately.

2. Description of Related Art

Conventionally, an in-car audio system has been known which selects a piece of music at random from a plurality of pieces of music to play it back. However, it is not unlikely for the audio system to play back a piece of music unsuitable for the conditions of the vehicle or the mood of an occupant of the vehicle at that time, and hence an improvement is desired. In view of this, an in-car music reproduction system has been developed which can automatically select a piece of music associated with a particular district such as a song which features local attractions, and play it back (see Relevant Reference 1, for example).

The music reproduction system includes a locating section for identifying the current position of a vehicle in response to the detection data fed from a GPS antenna, a MIDI reproducing section for reproducing BGM, and a hard disk that stores music data. The hard disk contains a music data storing section that stores the MIDI data for BGM reproduction, a map-related information storing section that stores map-related information representing relationships between the music data and districts, and a district information storing section indicating the region to which the current position belongs. A CPU locates the district from the current position the locating section obtains, selects a piece of music associated with the district with reference to the map-related information storing section, and plays back the music.

Relevant Reference 1: Japanese patent application laid-open No. 8-248953.

The conventional music reproduction system, however, has a problem of being unable to offer more suitable music to the occupant of the vehicle because it can make only rough music selection such as selecting music associated with the current position of the vehicle.

SUMMARY OF THE INVENTION

The present invention is implemented to solve the foregoing problem. It is therefore an object of the present invention to provide an automatic music selecting system capable of selecting music which is more suitable for an occupant of a mobile unit.

According to one aspect of the present invention, there is provided an automatic music selecting system in a mobile unit comprising: a music data storing section for storing music data corresponding to a plurality of pieces of music; a current position detecting section for detecting a current position of the mobile unit; a first keyword generating section for generating a first keyword in response to current position information indicating the current position detected by the current position detecting section; an environment detecting section for detecting environment of the mobile unit; a second keyword generating section for generating a second keyword in response to environment information indicating the environment detected by the environment detecting section; a music selecting section for selecting a piece of music in response to the first keyword generated by the first keyword generating section and to the second keyword generated by the second keyword generating section; and a reproducing section for reading music data corresponding to the piece of music selected by the music selecting section from the music data storing section, and for playing back the music data.

Thus, it offers an advantage of being able not only to select a piece of music associated with the current position of the vehicle, but also to select a piece of music more suitable for an occupant of the vehicle because it selects the piece of music in response to the environment of the vehicle.

DETAILED DESCRIPTION OF THE PREFERRED EMBODIMENTS

The invention will now be described with reference to the accompanying drawings.

Embodiment 1

Figure 1:
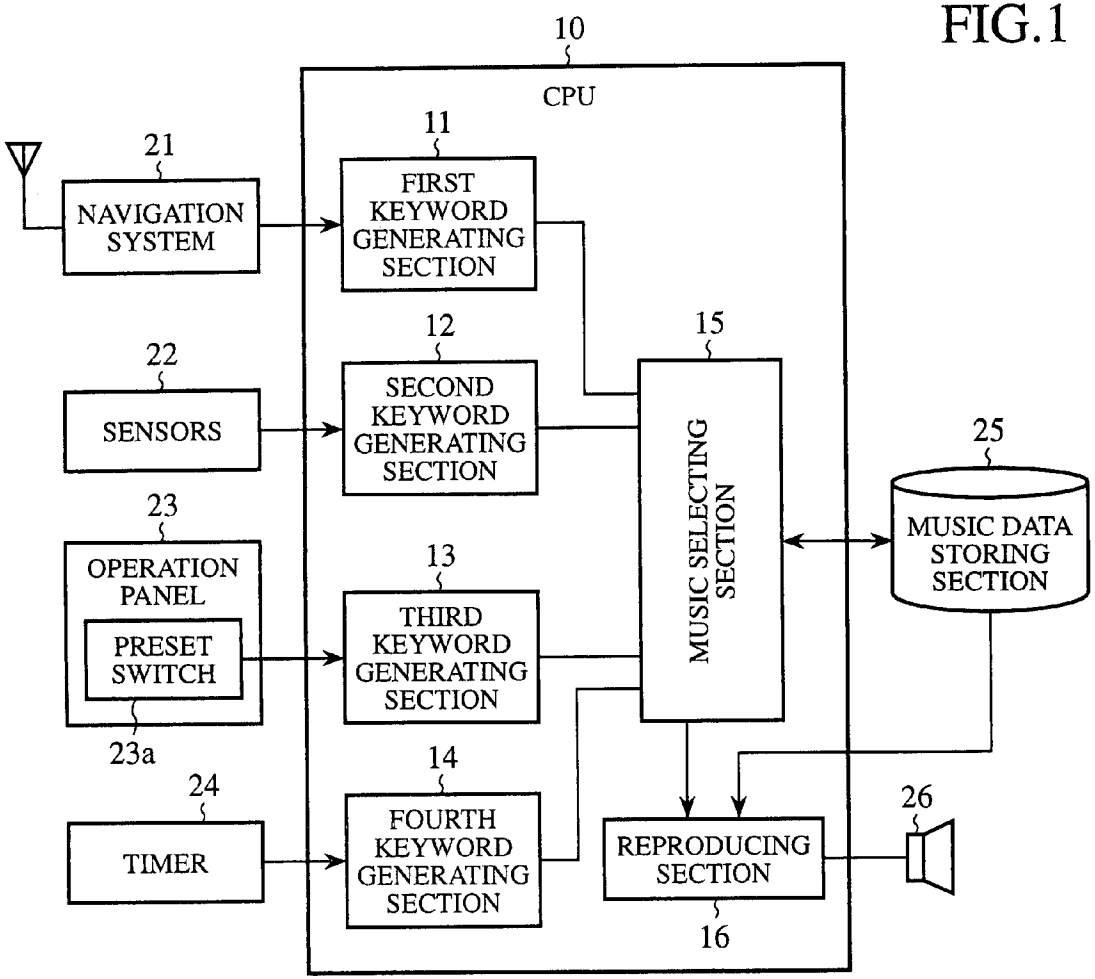
FIG. 1 is a block diagram showing a configuration of an embodiment 1 of the automatic music selecting system in accordance with the present invention.

FIG. 1 is a block diagram showing a configuration of an embodiment 1 of the automatic music selecting system in accordance with the present invention. The automatic music selecting system includes a CPU 10, a navigation system 21, sensors 22, an operation panel 23, a timer 24, a music data storing section 25 and a speaker 26.

The CPU 10 controls the automatic music selecting system in its entirety. The details of the CPU 10 will be described later.

The navigation system 21, which corresponds to a current position detecting section in accordance with the present invention, includes a GPS receiver, a direction sensor, a distance sensor and the like. The navigation system 21 calculates its own position in response to signals from the GPS receiver, direction sensor, distance sensor and the like. It displays a mark indicating the current position on a map to guide the driver to a destination. In addition to the foregoing original function, the navigation system 21 supplies the CPU 10 with the current position information about the current position.

The sensors 22 correspond to an environment detecting section in accordance with the present invention. Although not shown in the drawings, the sensors 22 includes a wiper sensor for detecting the on-state of a wiper; a sunroof sensor for detecting that a sunroof is open; a vehicle speed sensor for detecting the speed of the vehicle; a headlight sensor for detecting that the headlights are lighted; a fog lamp sensor for detecting the on-state of fog lamps; and a directional signal sensor for detecting the on-state of directional signals. The signals output from the sensors 22 are supplied to the CPU 10 as the environment information.

The operation panel 23 is used by a user to operate the automatic music selecting system. The operation panel 23 includes a preset switch 23*a* that corresponds to a user information input section in accordance with the present invention. The preset switch 23*a* includes, for example, six preset buttons 1–6 (not shown) which are used for inputting a third keyword which will be described later. In addition, the preset switch 23*a* is also used to preset radio stations. The user information about the set conditions of the preset buttons 1–6 constituting the preset switch 23*a* are supplied to the CPU 10.

The timer 24, which corresponds to a timer section in accordance with the present invention, counts time and date. The present time and date information obtained by the timer 24 is supplied to the CPU 10.

The music data storing section 25 includes a disk system, for example. The music data storing section 25 stores music data corresponding to a plurality of pieces of music and music information about their attributes. The music information includes titles of the pieces of music, artist names, genres, words of songs and the like. The CPU 10 uses the music data storing section 25 to retrieve a piece of music. In addition, the music data stored in the music data storing section 25 is supplied to the CPU 10.

The speaker 26 produces music in response to a music signal fed from the CPU 10. The speaker 26 is also used to provide speech information in response to the signal fed from the navigation system 21.

The CPU 10 includes a first keyword generating section 11, a second keyword generating section 12, a third keyword generating section 13, a fourth keyword generating section 14, a music selecting section 15 and a reproducing section 16, all of which are implemented by software processing in practice.

The first keyword generating section 11 generates a first keyword for retrieving in response to the current position information fed from the navigation system 21. The first keyword consists of a word associated with the current position. For example, when the first keyword generating section 11 makes a decision that the current position is riverside from the current position information fed from the navigation system 21, it generates the first keyword "river". The detail of the first keyword generated by the first keyword generating section 11 will be described later. The first keyword generated by the first keyword generating section 11 is supplied to the music selecting section 15.

The second keyword generating section 12 generates a second keyword for retrieving in response to the environment information about the environment of the vehicle fed from the sensors 22. The second keyword consists of a word associated with the environment of the vehicle. For example, when the second keyword generating section 12 makes a decision that the wiper is in the on-state from the signal fed from the wiper sensor in the sensors 22 as the environment information, it generates the second keyword "rain". The types of the second keyword generated by the second keyword generating section 12 will be described in detail later. The second keyword generated by the second keyword generating section 12 is supplied to the music selecting section 15.

The third keyword generating section 13 generates a third keyword for retrieving in response to the user information about the set conditions of the preset buttons 1–6 fed from the preset switch 23*a* of the operation panel 23. The third keyword consists of a word the user assigns to the preset buttons 1–6 in advance. For example, when the third keyword generating section 13 makes a decision that the preset buttons 1 to which the user assigns "pops" is tuned on, it generates the third keyword "pops". The types of the third keyword generated by the third keyword generating section 13 will be described in detail later. The third keyword generated by the third keyword generating section 13 is supplied to the music selecting section 15.

The fourth keyword generating section 14 generates a fourth keyword for retrieving in response to the present time and date information fed from the timer 24. The fourth keyword consists of a word associated with the present time and date. For example, when the present date is from March to May, the fourth keyword generating section 14 generates the fourth keyword "spring". The types of the fourth keyword generated by the fourth keyword generating section 14 will be described in detail later. The fourth keyword generated by the fourth keyword generating section 14 will be supplied to the music selecting section 15.

The music selecting section 15 retrieves the music information stored in the music data storing section 25 according to the first keyword from the first keyword generating section 11, the second keyword from the second keyword generating section 12, the third keyword from the third keyword generating section 13, and the fourth keyword from the fourth keyword generating section 14, and selects a piece of music meeting the first to fourth keywords. The music selecting section 15 supplies the name of the selected piece of music to the reproducing section 16.

Although the music selecting section 15 is configured such that it selects a piece of music by retrieving the music information in response to the first to fourth keywords, a configuration is also possible that retrieves the music information using at least two of the first to fourth keywords. The number of keywords to be used from the first to fourth keywords can be determined appropriately in accordance with the request of the system or user.

The reproducing section 16 reads from the music data storing section 25 the music data corresponding to the title fed from the music selecting section 15, and generates the music signal. The music signal generated by the reproducing section 16 is fed to the speaker 26. Thus, the speaker 26 produces the music.

Next, the operation of the embodiment 1 of the automatic music selecting system in accordance with the present invention with the foregoing configuration will be described with reference to the flowcharts of FIGS. 2–6.

Figure 2:
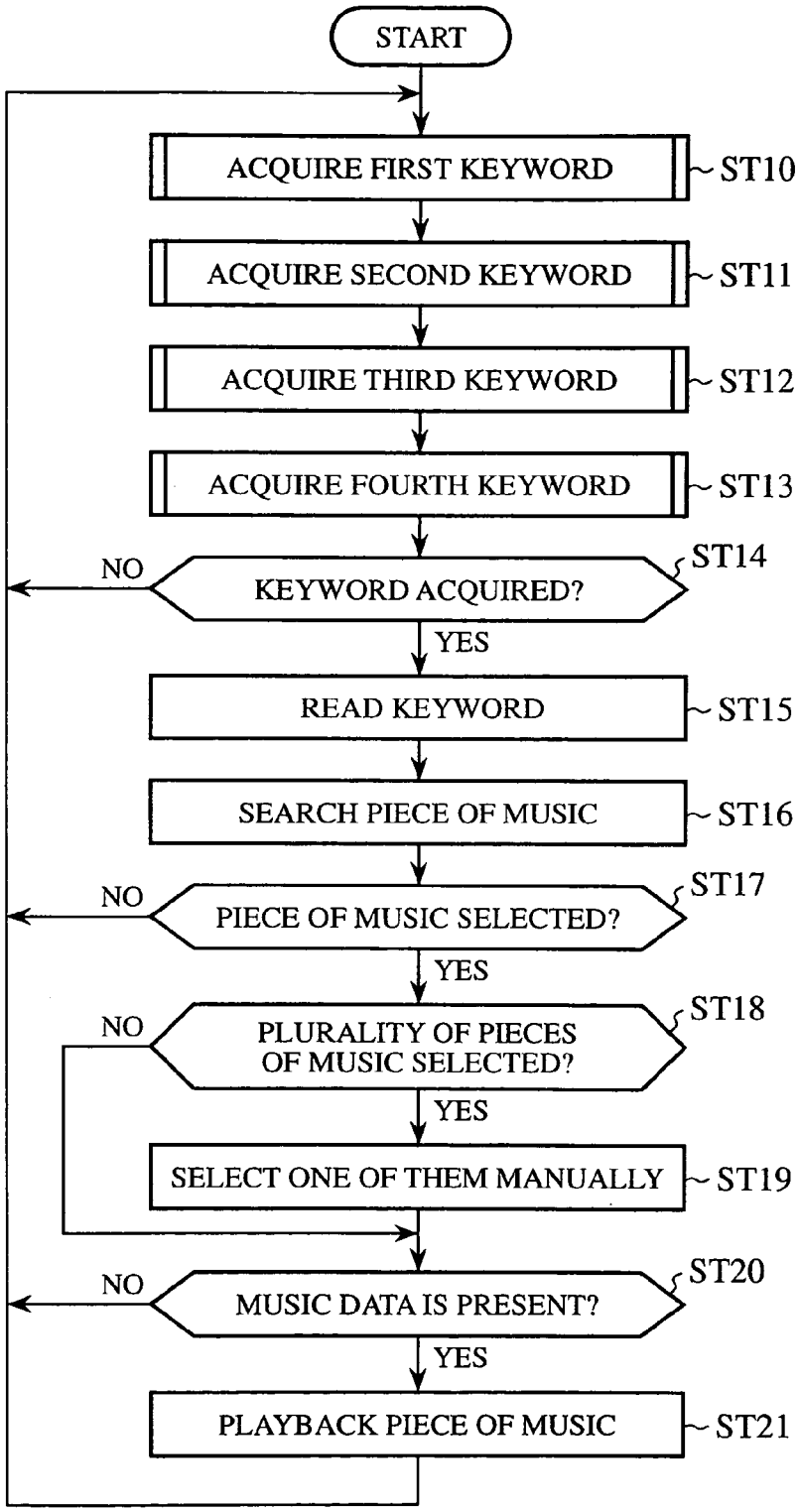
FIG. 2 is a flowchart illustrating the operation of the embodiment 1 of the automatic music selecting system in accordance with the present invention.
Figure 3:
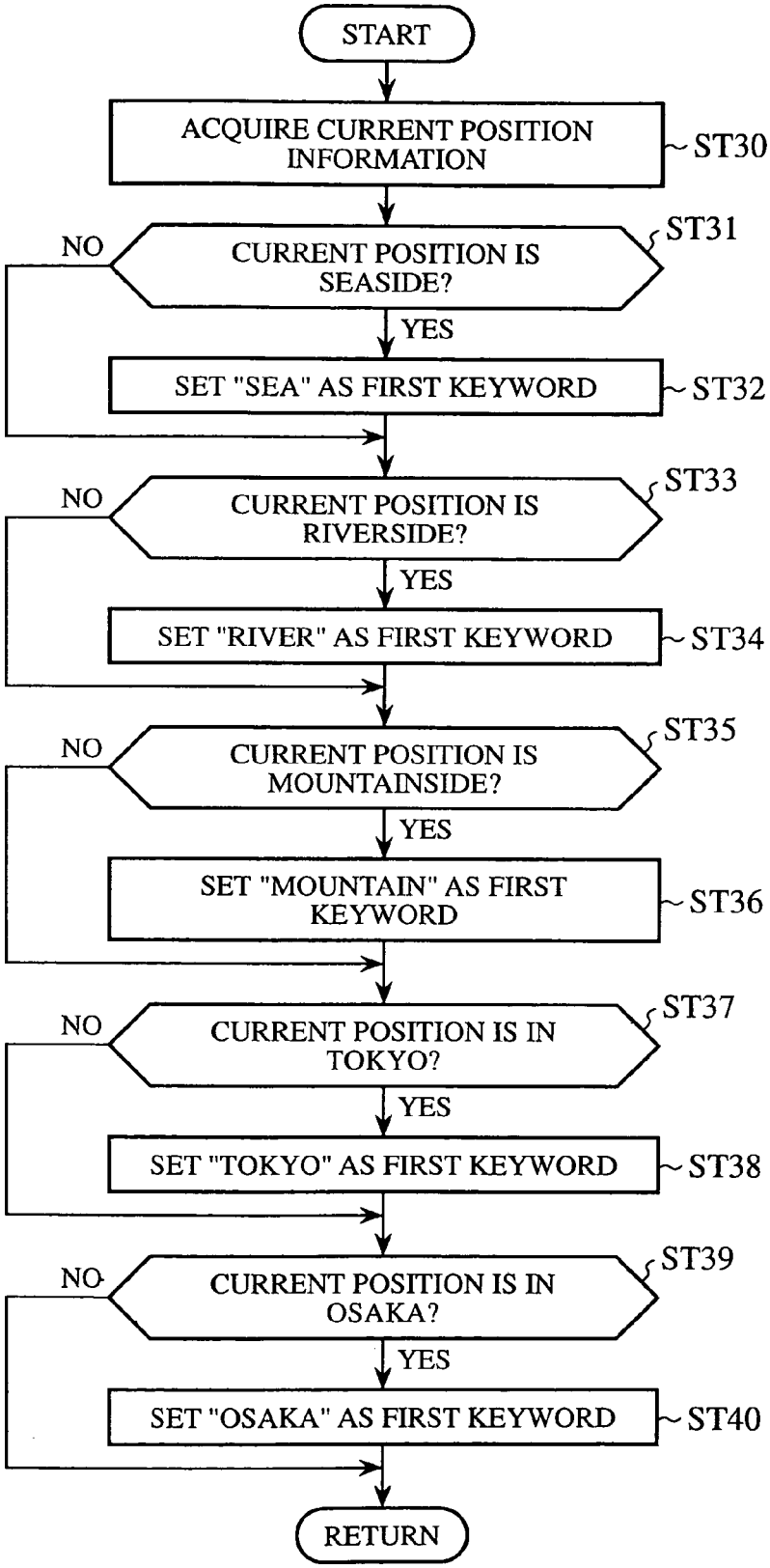
FIG. 3 is a flowchart illustrating the detail of the first keyword acquisition processing as illustrated in FIG. 2.

When the automatic music selecting system is activated, the automatic music selection processing as illustrated in the flowchart of FIG. 2 is started. In the automatic music selection processing, the first keyword is acquired first (step ST10). The first keyword acquisition processing is carried out by the first keyword generating section 11, and its detail is illustrated in the flowchart of FIG. 3.

In the first keyword acquisition processing, the first keyword generating section 11 acquires the current position information from the navigation system 21, first (step ST30). Subsequently, the first keyword generating section 11 checks whether the current position of the vehicle is seaside in response to the acquired current position information (step ST31) by comparing the current position information with the map information obtained from the navigation system 21. When the first keyword generating section 11 decides that the vehicle is on the seaside, it generates "sea" as the first keyword (step ST32). The first keyword "sea" is stored in a first keyword storing area (not shown) in the memory. On the other hand, if the first keyword generating section 11 decides that the vehicle is not on the seaside at step ST31, it skips the processing of step ST32.

Likewise, when the current position of the vehicle is riverside, the first keyword generating section 11 generates "river" as the first keyword (steps ST33 and ST34), and when the current position of the vehicle is at the skirts of a mountain, the first keyword generating section 11 generates "mountain" as the first keyword (steps ST35 and ST36). In addition, when the current position of the vehicle is in Tokyo, the first keyword generating section 11 generates "Tokyo" as the first keyword (steps ST37 and ST38), and when the current position of the vehicle is in Osaka, the first keyword generating section 11 generates "Osaka" as the first keyword (steps ST39 and ST40) The first keywords thus generated are each stored in the first keyword storing area. After that, the sequence is returned to the automatic music selection processing (FIG. 2).

The first keyword generating section 11 can generate various types of first keywords other than the above-mentioned "sea", "river", "mountain", "Tokyo" and "Osaka" in response to the current position information.

Figure 4:
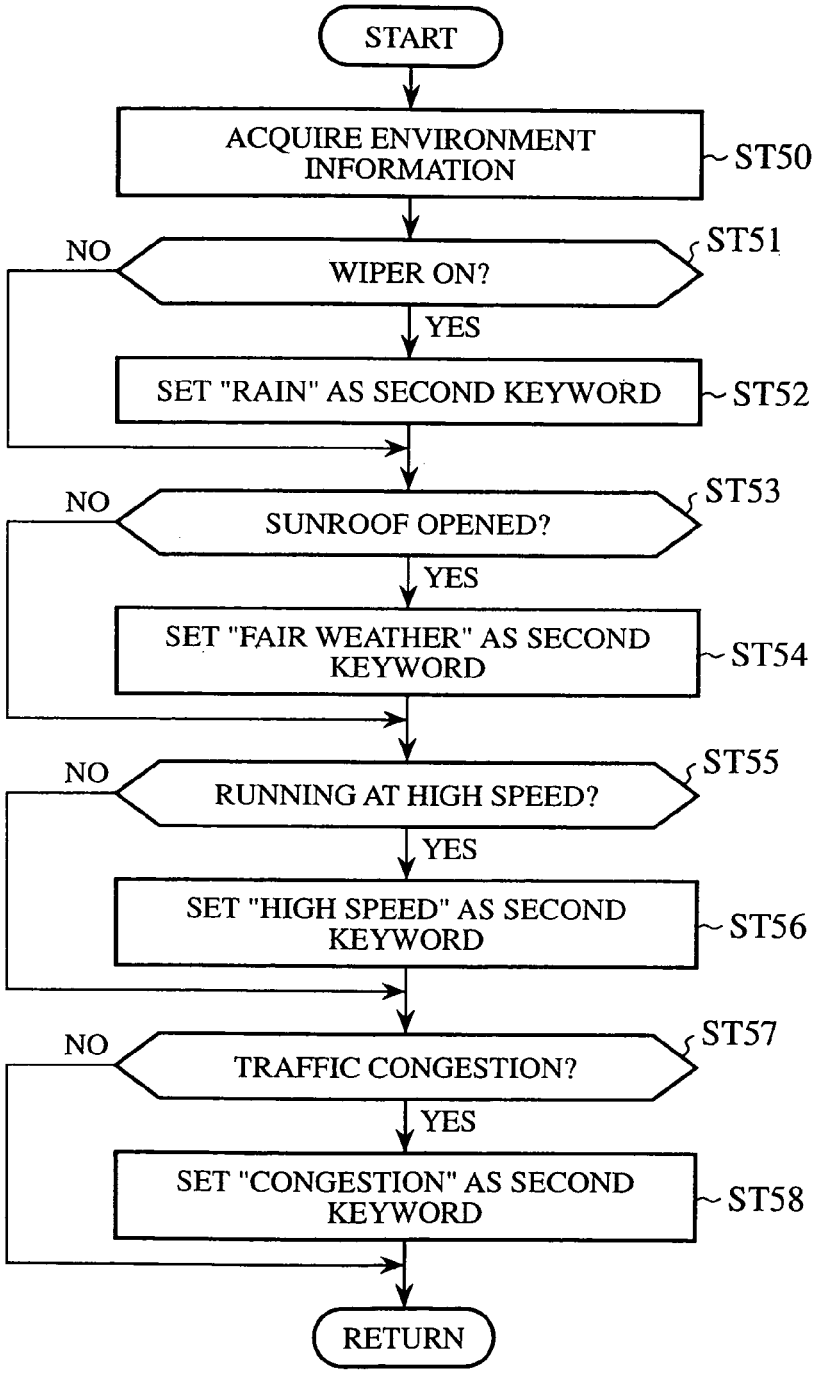
FIG. 4 is a flowchart illustrating the detail of the second keyword acquisition processing as illustrated in FIG. 2.

The automatic music selection processing acquires the second keyword next (step ST11). The second keyword acquisition processing is carried out by the second keyword generating section 12, the details of which are illustrated in the flowchart of FIG. 4.

In the second keyword acquisition processing, the second keyword generating section 12 acquires the environment information from the sensors 22, first (step ST50). Subsequently, the second keyword generating section 12 checks whether the wiper is in the on-state or not in response to the signal fed from the wiper sensor and contained in the acquired environment information (step ST51). When the second keyword generating section 12 decides that the wiper is in the on-state, it generates "rain" as the second keyword (step ST52). The generated second keyword "rain" is stored in the second keyword storing area (not shown) of the memory. On the other hand, when the second keyword generating section 12 decides that the wiper is in the off-state at step ST51, it skips the processing of step ST52.

Likewise, when the signal fed from the sunroof sensor indicates that the sunroof is open, the second keyword generating section 12 generates "fair weather" as the second keyword (steps ST53 and ST54). When the signal fed from the vehicle speed sensor indicates that it is above a predetermined value, that is, when the vehicle is traveling at a high speed, the second keyword generating section 12 generates "high speed" as the second keyword (step ST55 and ST56). In contrast, when the signal fed from the vehicle speed sensor is less than the predetermined value, that is, when the vehicle is traveling in a congested area, the second keyword generating section 12 generates "congestion" as the second keyword (steps ST57 and ST58). The second keywords thus generated are stored in the second keyword storing area. After that, the sequence is returned to the automatic music selection processing (FIG. 2).

The second keyword generating section 12 can generate various types of second keywords other than the foregoing "rain", "fair weather", "high speed" and "congestion" in response to the environment information. For example, the second keyword generating section 12 generates "night" as the second keyword when the headlight sensor detects that the headlight is lighted, generates "fog" as the second keyword when the fog lamp sensor detects that the fog lamp is lighted, and generates "corner" as the second keyword when the directional signal sensor detects that the directional signal is turned on.

Figure 5:
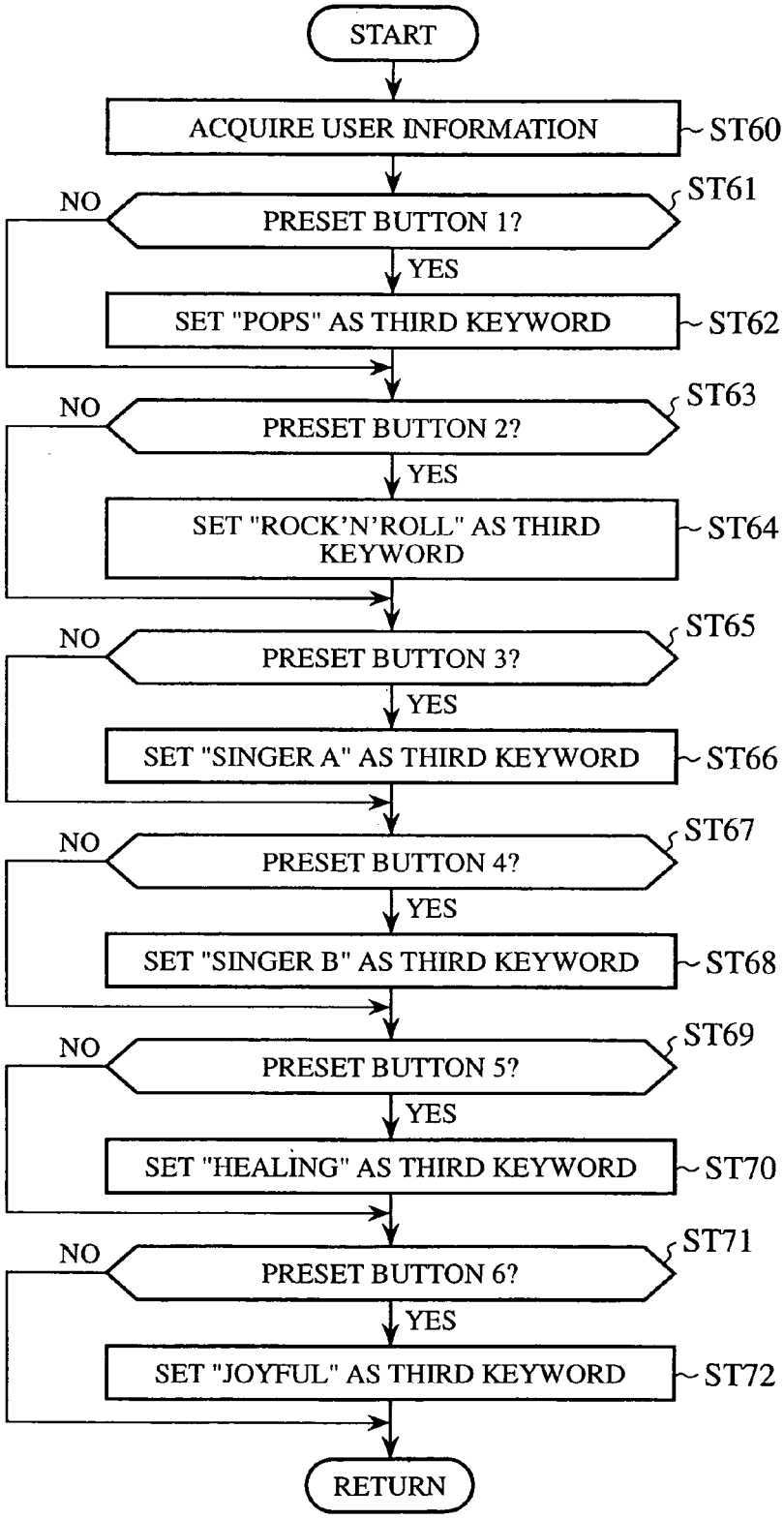
FIG. 5 is a flowchart illustrating the detail of the third keyword acquisition processing as illustrated in FIG. 2.

The automatic music selection processing acquires the third keyword next (step ST12). The third keyword acquisition processing is carried out by the third keyword generating section 13, the details of which are illustrated in the flowchart of FIG. 5.

In the third keyword acquisition processing, the third keyword generating section 13 acquires the user information from the preset switch 23*a* of the operation panel 23 (step ST60). Subsequently, the third keyword generating section 13 checks whether the preset button 1 is operated or not in response to the acquired user information (step ST61). When the third keyword generating section 13 decides that the preset button 1 is operated, it generates "pops" assigned to the preset button 1 as the third keyword (step ST62). The generated third keyword "pops" is stored in third keyword storing area (not shown) of the memory. On the other hand, when the third keyword generating section 13 decides that the preset button 1 is not operated at step ST61, it skips the processing of step ST62.

Likewise, when the third keyword generating section 13 decides that the preset button 2 is operated, it generates "rock'n'roll" assigned to the preset button 2 as the third keyword (steps ST63 and ST64). When the third keyword generating section 13 decides that the preset button 3 is operated, it generates "singer A" assigned to the preset button 3 as the third keyword (steps ST65 and ST66). When the third keyword generating section 13 decides that the preset button 4 is operated, it generates "singer B" assigned to the preset button 4 as the third keyword (steps ST67 and ST68). When the third keyword generating section 13 decides that the preset button 5 is operated, it generates "healing" assigned to the preset button 5 as the third keyword (steps ST69 and ST70). When the third keyword generating section 13 decides that the preset button 6 is operated, it generates "joyful" assigned to the preset button 6 as the third keyword (steps ST71 and ST72). These third words are each stored in the third keyword storing area. After that, the sequence is returned to the automatic music selection processing (FIG. 2).

The third keyword generating section 13 can generate various types of third keywords other than the above-mentioned "pops", "rock'n'roll", "singer A", "singer B", "healing" and "joyful" by assigning desired keywords to the preset buttons 1–6.

Figure 6:
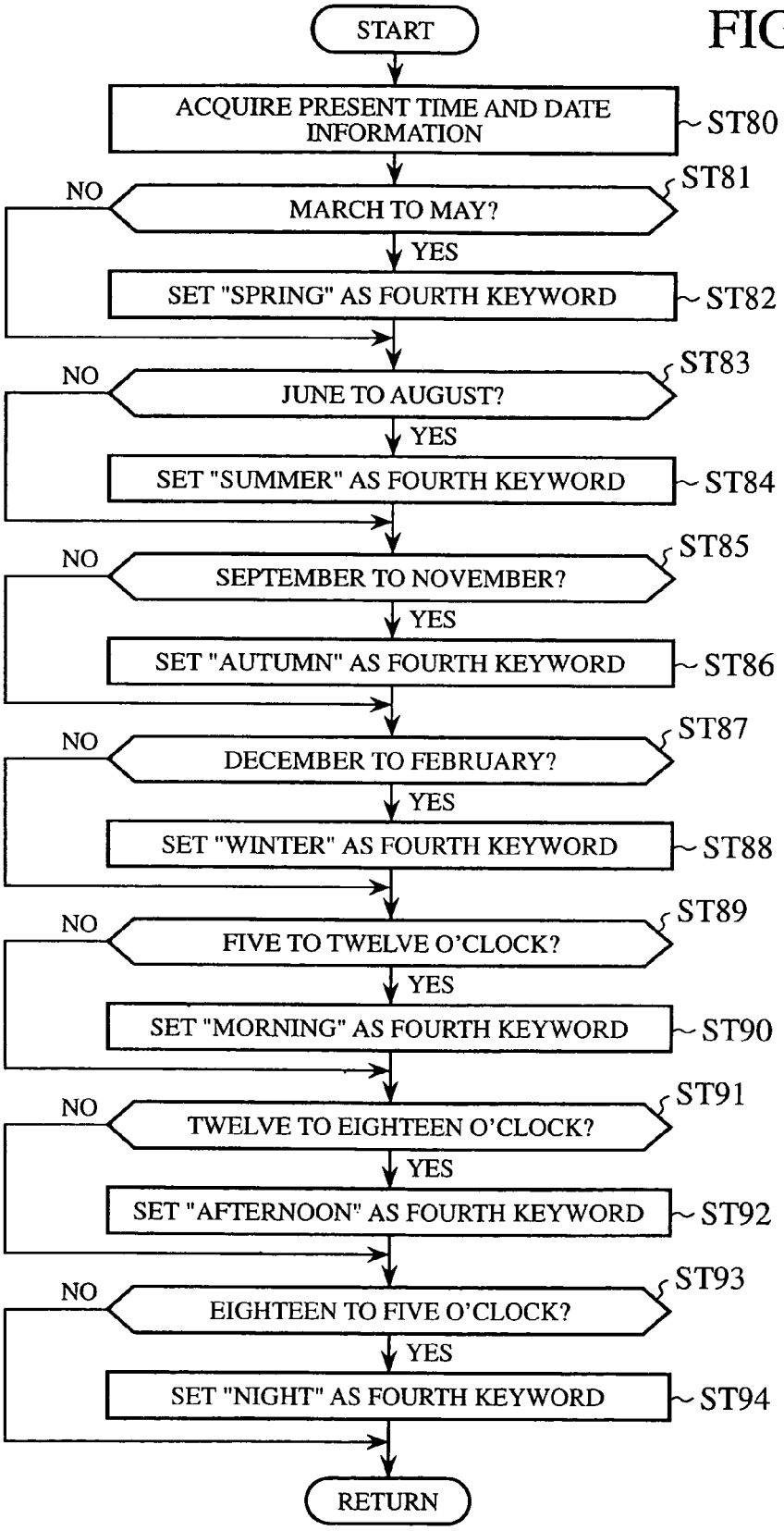
FIG. 6 is a flowchart illustrating the detail of the fourth keyword acquisition processing as illustrated in FIG. 2.

The automatic music selection processing acquires the fourth keyword next (step ST13). The fourth keyword acquisition processing is carried out by the fourth keyword generating section 14, the details of which are illustrated in the flowchart of FIG. 6.

In the fourth keyword acquisition processing, the fourth keyword generating section 14 acquires the present time and date information from the timer 24, first (step ST80). Subsequently, the fourth keyword generating section 14 checks whether the present date is from March to May in response to the acquired present time and date information (step ST81). When the fourth keyword generating section 14 decides that the date is from March to May, it generates "spring" as the fourth keyword (step ST82). The generated fourth keyword "spring" is stored in the fourth keyword storing area (not shown) of the memory. On the other hand, if the fourth keyword generating section 14 decides that the date is not from March to May at step ST81, it skips the processing of step ST82.

Likewise, when the present date is from June to April, the fourth keyword generating section 14 generates "summer" as the fourth keyword (steps ST83 and ST84). When the present date is from September to November, the fourth keyword generating section 14 generates "autumn" as the fourth keyword (steps ST85 and ST86), and generates "winter" as the fourth keyword when the present date is from December to February (steps ST87 and ST88). On the other hand, when the present time is from five to twelve o'clock, the fourth keyword generating section 14 generates "morning" as the fourth keyword (steps ST89 and ST90) Likewise, when the present time is from twelve to eighteen o'clock, the fourth keyword generating section 14 generates "afternoon" as the fourth keyword (steps ST91 and ST92). When the present time is from eighteen to five o'clock, the fourth keyword generating section 14 generates "night" as the fourth keyword (steps ST93 and ST94). These fourth keywords are each stored in the fourth keyword storing area. After that, the sequence is returned to the automatic music selection processing (FIG. 2).

The fourth keyword generating section 14 can generate various types of fourth keywords other than the above-mentioned "spring", "summer", "autumn", "winter", "morning", "afternoon" and "night" in response to the present time information.

Next, the automatic music selection processing checks whether it can acquire the keyword or not (step ST14) by checking whether any one of the first to fourth keywords are stored in the keyword storing areas of the first to fourth keyword generating sections 11–14. If the automatic music selection processing makes a decision that it cannot acquire any keywords, it returns the sequence to step ST10 to repeat the foregoing operation again.

On the other hand, if the automatic music selection processing makes a decision that it can acquire any keywords at step ST14, the music selecting section 15 reads the keywords from the first to fourth keyword storing areas (step ST15). In this case, the input keywords are assigned priority so that they are used for retrieving a piece of music sequentially in descending order of priority.

Subsequently, the music selecting section 15 retrieves a piece of music (step ST16). More specifically, the music selecting section 15 checks whether the music information (the titles, artist names, genres, words of songs) stored in the music data storing section 25 includes a piece of music including the same words as the keywords input at step ST15.

Subsequently, the music selecting section 15 checks whether a title is selected or not (step ST17). If the music selecting section 15 decides that the title is not selected, it returns the sequence to step ST10 to repeat the same operation as described above.

On the other hand, when the music selecting section 15 can select the title, it checks whether it selects a plurality of titles or not (step ST18). When the music selecting section 15 selects a plurality of titles, it carries out the processing for the user to manually select one of the titles (step ST19) More specifically, the music selecting section 15 displays the selected titles on a display unit not shown, and has the user select one of them. After the manual selection of the title, the music selecting section 15 advances the sequence to step ST20. When the music selecting section 15 does not select the plurality of titles at step ST18, that is, when it selects only a single piece of music, it skips the processing of step ST19.

At step ST20, the music selecting section 15 checks whether the music data corresponds to the selected title is present in the music data storing section 25 or not. When it makes a decision that such music data is not present, it returns the sequence to step ST10 to repeat the same operation as described above. Thus, the function of selecting the next music can be implemented when the music data has already been eliminated with remaining only the music information.

When a decision is made that the music data is present at step ST20, the piece of music is played back (step ST21). Specifically, the music selecting section 15 hands the title to the reproducing section 16. Receiving the title, the reproducing section 16 reads the music data corresponds to the title from the music data storing section 25, generates the music signal and supplies it to the speaker 26 except for the case where the reproducing section 16 is playing back the previously selected music. Thus, the piece of music which is automatically selected is produced from the speaker 26. Incidentally, when the previously selected piece of music is being played back by the reproducing section 16, the current piece of music with the title provided by the music selecting section 15 is played back after completing the preceding piece.

After that, the sequence is returned to step ST10 to repeat the same operation as described above, which makes it possible to select the next piece of music during the playback of the previous piece of music.

As described above, the embodiment 1 of the automatic music selecting system in accordance with the present invention not only selects the music associated with the current position of the vehicle, but also selects and reproduces the music in response to the environment of the vehicle, to the time and date, and to the intention of the user. As a result, it can select a piece of music more suitable for the occupant of the vehicle.

Embodiment 2

The embodiment 2 of the automatic music selecting system in accordance with the present invention is configured such that the music selection is made by a server connected to the Internet.

Figure 7:
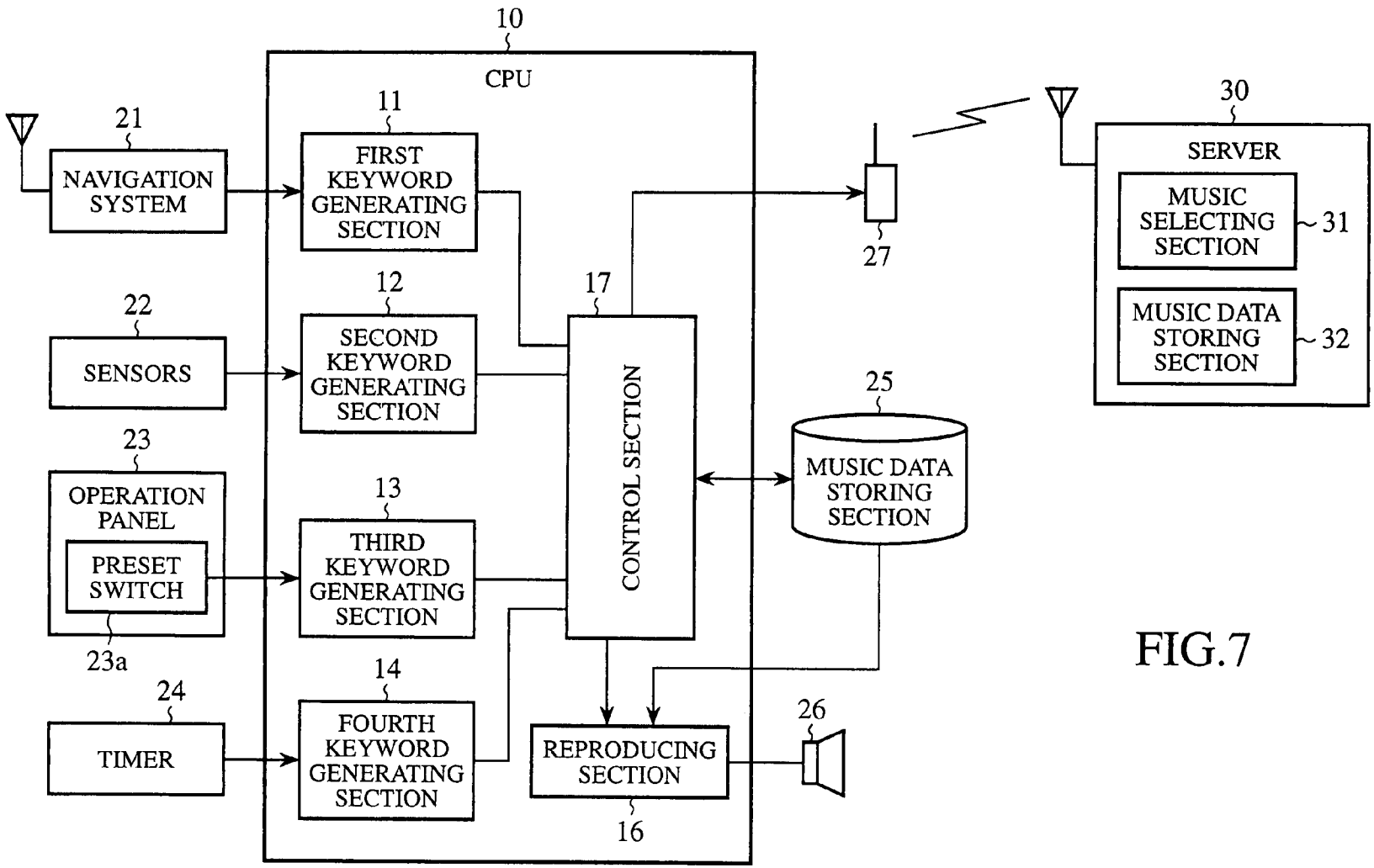
FIG. 7 is a block diagram showing a configuration of an embodiment 2 of the automatic music selecting system in accordance with the present invention.

FIG. 7 is a block diagram showing a configuration of the embodiment 2 of the automatic music selecting system in accordance with the present invention. The automatic music selecting system is configured by adding a mobile phone 27 and a server 30 to the embodiment 1 of the automatic music selecting system (FIG. 1). In FIG. 7, the same or like components to those of the embodiment 1 of the automatic music selecting system are designated by the same reference numerals, and their description is omitted here.

The mobile phone 27, which constitutes a communication section in accordance with the present invention, connects the CPU 10 to the Internet by radio. The Internet corresponds to the network in accordance with the present invention.

The server 30 is composed of a server computer connected to the Internet, and provides a user with retrieval service and music data distribution service. The server 30 includes a music selecting section 31 and a music data storing section 32. The music selecting section 31 has functions equal to or higher than those of the music selecting section 15 of the CPU 10 of the embodiment 1.

The music data storing section 32 of the server 30 stores music data corresponding to a plurality of pieces of music and music information about their attributes in the same manner as the music data storing section 25. However, the music data storing section 32 of the server 30 contains a much greater amount of music (music data and music information) than the music data storing section 25. In addition, it includes a greater amount of and more complete music information than the music data storing section 25.

The music selecting section 31 of the server 30 searches the music information stored in the music data storing section 32 in response to the first to fourth keywords transmitted from the CPU 10 via the mobile phone 27 and the Internet, and selects a piece of music corresponding to the first to fourth keywords. The title of the selected piece of music is transmitted to the CPU 10 via the Internet and mobile phone 27.

The CPU 10 of the embodiment 2 is configured by removing the music selecting section 15 from the CPU 10 of the embodiment 1, and by adding a control section 17 thereto. The control section 17, which constitutes the communication section in accordance with the present invention, supplies the mobile phone 27 with the first keyword from the first keyword generating section 11, the second keyword from the second keyword generating section 12, the third keyword from the third keyword generating section 13, and the fourth keyword from the fourth keyword generating section 14. Thus, the keywords used for the music selection are transmitted to the music selecting section 31 of the server 30. In addition, the control section 17 receives the title of the selected piece of music transmitted from the music selecting section 31 of the server 30 via the Internet and mobile phone 27, and supplies it to the reproducing section 16.

Next, the operation of the embodiment 2 of the automatic music selecting system in accordance with the present invention with the foregoing configuration will be described with reference to the flowchart illustrated in FIG. 8. In the following description, the same processing steps as those of the embodiment 1 of the automatic music selecting system are designated by the same reference symbols, and their description is omitted here for the sake of simplicity.

Figure 8:
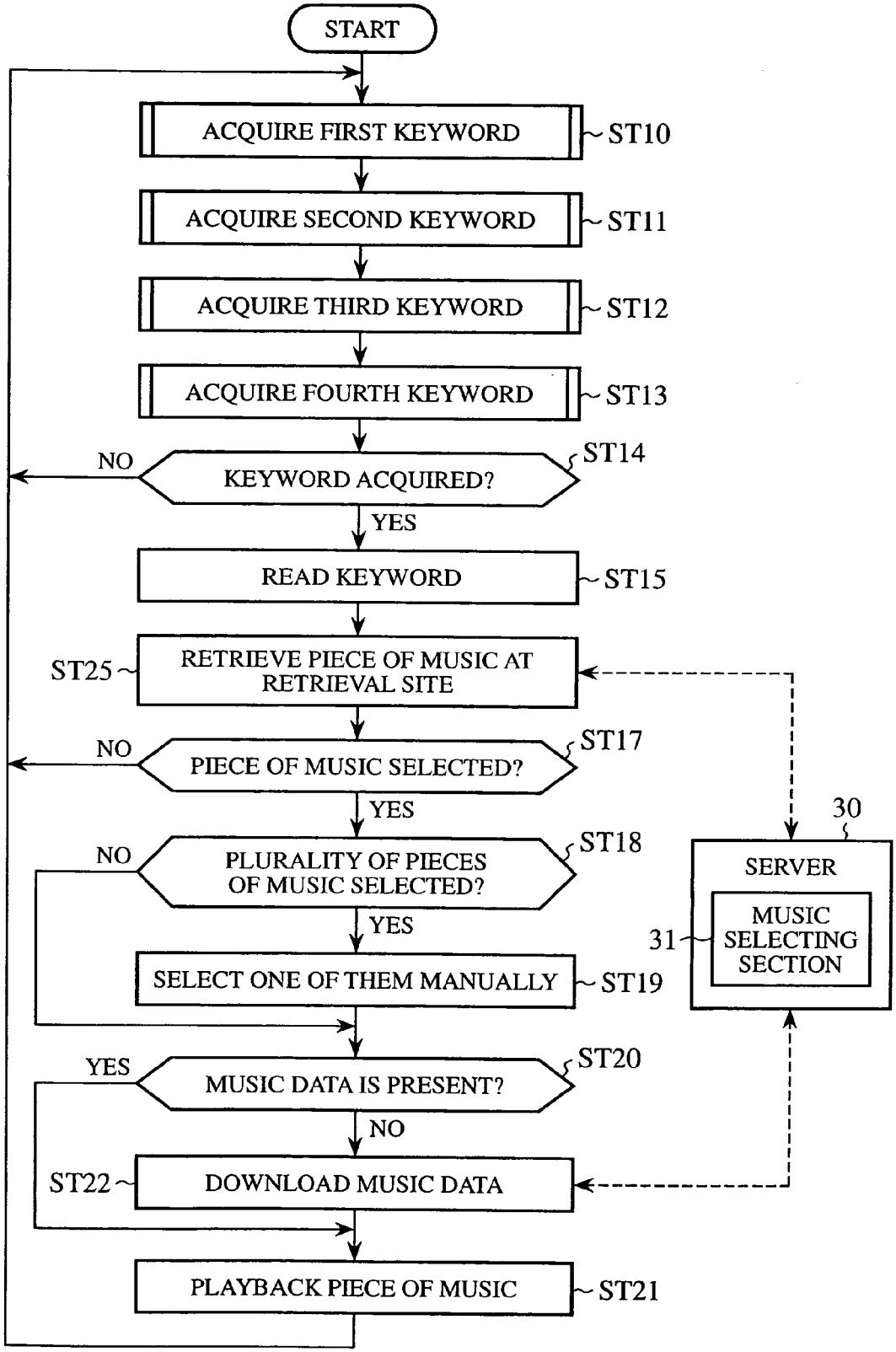
FIG. 8 is a flowchart illustrating the operation of the embodiment 2 of the automatic music selecting system in accordance with the present invention.

When the automatic music selecting system is activated, the automatic music selection processing as illustrated in the flowchart of FIG. 8 is started by the control section 17. In the automatic music selection processing, the first to fourth keywords are acquired as in the embodiment 1, first (steps ST10–ST13).

Subsequently, the automatic music selection processing checks whether it can acquire the keyword or not (step ST14). If it makes a decision that it cannot acquire any keywords, it returns the sequence to step ST10 to repeat the foregoing operation again.

On the other hand, if the automatic music selection processing makes a decision that it can acquire any keywords at step ST14, the control section 17 reads the keywords from the first to fourth keyword storing areas (step ST15). In this case, the input keywords are assigned priority so that they are used for retrieving a piece of music sequentially in descending order of priority.

Subsequently, the control section 17 has the retrieval site retrieve a piece of music (step ST25). More specifically, the control section 17 transmits the first to fourth keywords read at step ST15 to the music selecting section 31 of the server 30 via the mobile phone 27 and the Internet. The music selecting section 31 of the server 30 checks whether the music information (the titles, artist names, genres, words of songs) stored in the music data storing section 32 includes a piece of music including the same words as the keywords received from the CPU 10, and transmits the resultant information to the control section 17 in the CPU 10 via the Internet and mobile phone 27.

Subsequently, the control section 17 checks whether a title is selected or not in response to the information obtained at step ST25 (step ST17). If the control section 17 decides that the title is not selected, it returns the sequence to step ST10 to repeat the same operation as described above.

On the other hand, when the control section 17 makes a decision that the title is selected, it checks whether a plurality of titles are selected or not (step ST18). When the control section 17 decides that a plurality of titles are selected, it carries out the processing for the user to manually select one of the titles (step ST19). After the manual selection of the title, the control section 17 advances the sequence to step ST20. When the control section 17 does not decide that the plurality of titles are selected at step ST18, that is, when only a single piece of music is selected, the control section 17 skips the processing of step ST19.

At step ST20, the control section 17 checks whether the music data corresponding to the selected title is present in the music data storing section 25 or not. When it makes a decision that such music data is not present, the download of the music data is carried out (step ST22). Specifically, the control section 17 downloads the music data and music information corresponding to the selected title from the music data storing section 32 of the server 30, and stores them to the music data storing section 25. After that, the sequence branches to step ST21.

When a decision is made that the music data is present at step ST20, or when the download of the music data is completed at step ST22, the piece of music is played back (step ST21). Thus, the piece of music that is automatically selected is produced from the speaker 26. Incidentally, when the previously selected piece of music is being played back by the reproducing section 16, the current piece of music with the title provided by the music selecting section 15 is played back after completing the preceding piece.

After that, the sequence is returned to step ST10 to repeat the same operation as described above, which makes it possible to select the next piece of music during the playback of the previous piece of music.

As described above, the embodiment 2 of the automatic music selecting system in accordance with the present invention is configured such that the retrieval of a piece of music based on the keyword is carried out by the server 30. Consequently, the likelihood of selecting a piece of music matching the keyword is increased because it is selected from a much greater number of pieces of music than those stored in the music data storing section 25 on the vehicle. In addition, since the amount of music information stored in the music data storing section 32 of the server 30 is greater and more complete than that stored in the music data storing section 25, the present embodiment 2 can automatically select a piece of music more suitable for the occupant of the vehicle.

In addition, the present embodiment 2 is configured such that when it does not include in the music data storing section 25 the music data with the title selected by the server 30, it downloads the music data from the server 30 and stores the music data in the music data storing section 25 before the playback. Thus, it can offer the occupant of the vehicle a piece of music more suitable for the keyword.

Although the embodiment 2 is configured such that when it does not include the music data with the selected title in the music data storing section 25, it downloads from the server 30, this is not essential. Such a configuration is also possible that selects the next piece of music as in the embodiment 1 of the automatic music selecting system, when the music data with the selected title is not present in the music data storing section 25.

Although the embodiments 1 and 2 are configured such that when a plurality of titles are selected, the use selects one of them manually, this is not essential. For example, such a configuration is also possible that reproduces a plurality of pieces of music sequentially, when a plurality of titles are selected.

What is claimed is:

1. An automatic music selecting system in a mobile unit comprising:

a music data storing section for storing music data corresponding to a plurality of pieces of music;

a current position detecting section for detecting a current position of the mobile unit;

a first keyword generating section for generating a first keyword in response to current position information indicating the current position detected by said current position detecting section;

an environment detecting section for detecting environment of the mobile unit;

a second keyword generating section for generating a second keyword in response to environment information indicating the environment detected by said environment detecting section;

a music selecting section for selecting a piece of music in response to the first keyword generated by said first keyword generating section and to the second keyword generated by said second keyword generating section; and a reproducing section for reading music data corresponding to the piece of music selected by said music selecting section from said music data storing section, and for playing back the music data.

2. The automatic music selecting system in a mobile unit according to claim 1, wherein said music selecting section is installed in a server connected to a network, wherein said automatic music selecting system further comprises:

a communication section for transmitting the first keyword and the second keyword to a music selecting section of said server via the network, and for receiving music selection information indicating a piece of music selected by said music selecting section in response to the first keyword and the second keyword, and wherein said reproducing section reads music data corresponding to the music selection information received by said communication section from said music data storing section, and plays back the music data.

3. The automatic music selecting system in a mobile unit according to claim 2, wherein said reproducing section downloads, when said music data storing section does not store music data of the piece of music selected by said music selecting section of the server, the music data from the server, and plays back the music data.

4. The automatic music selecting system in a mobile unit according to claim 1, further comprising:

a user information input section for inputting user information specified by a user; and a third keyword generating section for generating a third keyword in response to the user information input from said user information input section, wherein, said music selecting section selects a piece of music in response to the first keyword generated by said first keyword generating section, the second keyword generated by said second keyword generating section and the third keyword generated by said third keyword generating section.

5. The automatic music selecting system in a mobile unit according to claim 4, wherein said music selecting section is installed in a server connected to a network, wherein said automatic music selecting system further comprises:

a communication section for transmitting the first keyword, the second keyword and the third keyword to a music selecting section of said server via the network, and for receiving music selection information indicating a piece of music selected by said music selecting section in response to the first keyword, the second keyword and the third keyword, and wherein said reproducing section reads music data corresponding to the music selection information received by said communication section from said music data storing section, and plays back the music data.

6. The automatic music selecting system in a mobile unit according to claim 5, wherein said reproducing section downloads, when said music data storing section does not store music data of the piece of music selected by said music selecting section of the server, the music data from the server, and plays back the music data.

7. The automatic music selecting system in a mobile unit according to claim 4, further comprising:

a timer section for inputting present time and date information indicating present time and date; and a fourth keyword generating section for generating a fourth keyword in response to the present time and date information input from said timer section, wherein said music selecting section selects a piece of music in response to the first keyword generated by said first keyword generating section, the second keyword generated by said second keyword generating section, the third keyword generated by said third keyword generating section and the fourth keyword generated by said fourth keyword generating section.

8. The automatic music selecting system in a mobile unit according to claim 7, wherein said music selecting section is installed in a server connected to a network, wherein said automatic music selecting system further comprises:

a communication section for transmitting the first keyword, the second keyword, the third keyword and the fourth keyword to a music selecting section of said server via the network, and for receiving music selection information indicating a piece of music selected by said music selecting section in response to the first keyword, the second keyword, the third keyword and the fourth keyword and wherein said reproducing section reads music data corresponding to the music selection information received by said communication section from said music data storing section, and plays back the music data.

9. The automatic music selecting system in a mobile unit according to claim 8, wherein said reproducing section downloads, when said music data storing section does not store music data of the piece of music selected by said music selecting section of the server, the music data from the server, and plays back the music data.

* * * * *